US005906199A

United States Patent [19]

Budzinski

[11] Patent Number: 5,906,199

[45] Date of Patent: May 25, 1999

[54] COLLAPSIBLE SNORKEL

[76] Inventor: Paul F. Budzinski, 21906 Shenandoah, Lake Forest, Calif. 92630

[21] Appl. No.: 09/066,804

[22] Filed: Apr. 24, 1998

[51] Int. Cl.[6] ..... B63C 11/16

[52] U.S. Cl. ..... 128/201.11; 128/201.27

[58] Field of Search ..... 128/201.27, 201.28, 128/201.11

[56] References Cited

U.S. PATENT DOCUMENTS

| | | | |
|---|---|---|---|
| 1,197,115 | 9/1916 | Fell et al. | 128/201.11 |
| 4,562,836 | 1/1986 | Perron | 128/201.11 |
| 4,878,491 | 11/1989 | McGilvray, III | 128/201.11 |
| 4,907,582 | 3/1990 | Meyerrose | 128/201.11 |
| 5,027,805 | 7/1991 | Kung | 128/201.11 |
| 5,239,990 | 8/1993 | Delphia | 128/201.11 |
| 5,261,396 | 11/1993 | Faulconer et al. | 128/201.11 |
| 5,265,591 | 11/1993 | Ferguson | 128/201.11 |
| 5,280,785 | 1/1994 | Fujima | 128/201.11 |
| 5,529,057 | 6/1996 | Ferroro et al. | 128/201.11 |

FOREIGN PATENT DOCUMENTS

| | | | |
|---|---|---|---|
| 1515610 | 1/1968 | France | 128/201.11 |
| 257375 | 10/1967 | Germany | 128/201.11 |
| 472977 | 7/1952 | Italy | 128/201.11 |

*Primary Examiner*—Aaron J. Lewis
*Attorney, Agent, or Firm*—Stetina Brunda Garred & Brucker

[57] ABSTRACT

A collapsible snorkel capable of selectively assuming a first fully-functional configuration and a second collapsed configuration such that when not in use, the snorkel is maintained in a space-efficient configuration so as to minimize interference with the swimmer/diver. In a preferred embodiment, the snorkel comprises an elongate breathing tube having proximal, intermediate, and distal portions. The intermediate portion may be selectively lengthened or shortened so that the snorkel may assume either the first functional configuration or the second compact configuration.

12 Claims, 2 Drawing Sheets

Fig. 1
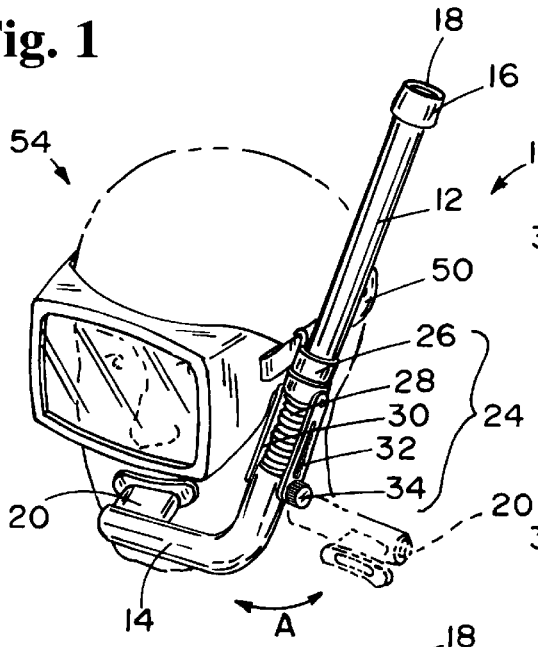
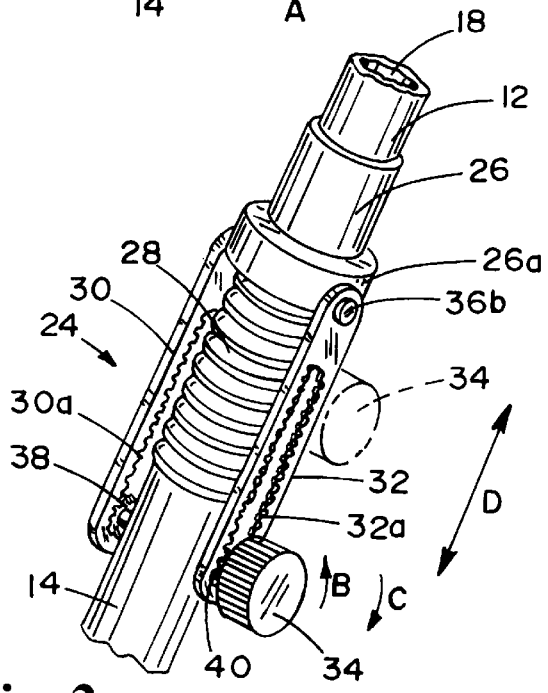
Fig. 2
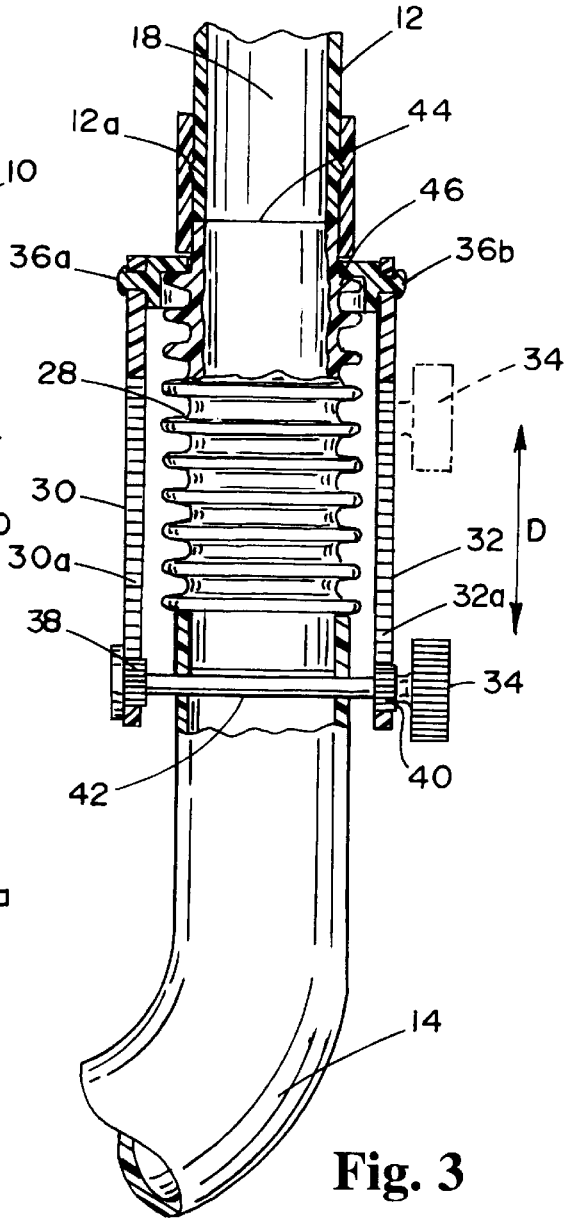
Fig. 3

COLLAPSIBLE SNORKEL

FIELD OF THE INVENTION

The present invention relates generally to snorkels, and more particularly, snorkels having breathing tubes that may be selectively lengthened or shortened so as to minimize interference with the swimmer/diver.

BACKGROUND OF THE INVENTION

Snorkels, as typically utilized in skin diving and scuba diving activities, are well-known to those skilled in the art. Generally, such snorkels have a mouth piece formed upon the proximal end of a breathing tube, the latter extending around the diver's face to a location above the diver's head where the distal end thereof is open. The snorkel permits the diver to breathe while his/her face is submerged in water a short distance below the surface. In this regard, the diver is able to breathe air from the atmosphere while he/she is able to swim in a prone position just underneath the water's surface.

Once the diver dives below the surface of the water, however, the snorkel is no longer capable of being utilized. In the context of scuba diving, the diver must rely upon air provided by air tanks, typically strapped to the back of the diver, and inhale the same via a regulator. Because the snorkel is still maintained in close proximity to the diver's head and mouth, typically due to the fact that the snorkel is strapped to the head of the diver via an underwater mask strap, the snorkel is thus maintained in a position that can interfere with the diver's field of vision and/or ability to breathe through the regulator during the dive. The shape and positioning of the snorkel can further interfere and become entangled with other scuba diving equipment, namely, the buoyancy compensator and regulator hoses. Moreover, the snorkel can substantially interfere with the ability of the diver to maneuver through cramped spaces, such as caves and shipwrecks.

While attempts have been made in the prior art to provide a snorkel that feels comfortable to the diver while strapped to his/her head, such attempts, to date, have proven unsuccessful. Among such prior art devices include those snorkels disclosed in U.S. Pat. No. 3,993,060 to Mitchell entitled DIVING SNORKEL WITH CONVOLUTED TUBE, which discloses an integrally molded snorkel formed of rubber and having a mouthpiece and flexible section with a substantially smooth innerwall and an external annular ribs spaced apart by thin walled intermediate sections. The thin walled intermediate sections provide flexibility to permit bending of the snorkel tube while the solid ribs prevent collapsing of the tube when the same is bent. While the flexible nature of the breathing tube disclosed in Mitchell enables the same to conform to the contours of the diver's face, however, such snorkel is still nevertheless bulky and can substantially interfere with the diver's field of vision during a dive. Such snorkel further fails to properly position the mouthpiece thereof sufficiently away from the diver's mouth so that the same does not interfere with the diver's alternative use of a regulator in place thereof.

Accordingly, there is a need in the art for a snorkel that can operate as a fully-function snorkel, as per conventional snorkel devices, but is further capable of assuming a compact space-efficient configuration such that when not in use, the snorkel causes minimal interference with the diver. There is a further need in the art for such a snorkel that is of simple construction and may be easily and readily utilized.

SUMMARY OF THE INVENTION

The present invention specifically address and alleviates the above-identified deficiencies in the art. Specifically, the present invention is directed to a snorkel capable of selectively assuming a first fully-functional configuration whereby the snorkel operates as a conventional snorkel device, and a second collapsed configuration such that when not in use, the snorkel is maintained in a space-efficient, compact configuration so as to minimize interference with the diver. According to one preferred embodiment, the snorkel comprises an elongate breathing tube having; (1) a distal section with an inlet formed at the distal-most end thereof for receiving air; (2) a proximal section having a mouthpiece formed thereon for engaging with the user's mouth; and (3) an intermediate section disposed between the proximal and distal portions that can be selectively lengthened or shortened as may be desired by the diver. In a preferred embodiment, the intermediate breathing tube section comprises a length of ribbed tubing designed to be either lengthened or shortened in an accordion-like manner. At least one elongated adjuster rail is provided that is anchored to a respective one of the opposed ends of the ribbed tubing. The adjuster rail as a plurality of teeth formed thereon for engaging with a gear member, the latter being anchored to the respective other opposed end of the ribbed tubing. A knob formed upon the gear member is provided such that when the knob is rotated in a first direction, the gear member, by virtue of its connection to the rail member, causes the ribbed tubing to increase in length. By rotating the knob in the opposite direction, the tubing is caused to shorten in length.

In an alternative preferred embodiment, the intermediate breathing tube section is formed from at least one segment of stretchable, elastic material that includes at least one elongate spring member disposed within the lumen thereof. A switching device formed along the length of the intermediate breathing tube section is provided to enable the user to selectively cause the device to transition between the first fully-functional configuration and the second collapsed configuration. The snorkel may be rotated about the diver's mask strap to which it is attached to further minimize interferences. In still further refinements of the present invention, the intermediate breathing tube section may be formed of multiple breathing tube sections telescoped within one another to assume both compact and expanded configurations.

It is therefore an object of the present invention to provide a snorkel that is capable of selectively assuming a fully-functional configuration and a second collapsed configuration such that when not in use, the snorkel is maintained in a space-efficient, compact configuration.

Another object of the present invention is to provide a snorkel capable of selectively assuming a first fully-functional configuration and a second collapsed configuration such that when the snorkel is maintained to the second collapsed configuration, such snorkel provides significantly less interference to the user when not in use than prior art snorkel devices.

Another object of the present invention is to provide a snorkel capable of selectively assuming a first fully-functional configuration and a second collapsed configuration that is of simple construction, inexpensive to manufacture, easy to utilize, and may be readily deployed with conventional scuba diving equipment.

BRIEF DESCRIPTION OF THE DRAWINGS

These, as well as other features of the present invention, will become more apparent upon reference to the drawings, wherein:

FIG. 1 is a perspective view of the head of a diver utilizing a snorkel constructed according to a first preferred embodiment of the present invention;

FIG. 2 is a perspective view of the intermediate section of the breathing tube of the snorkel depicted in FIG. 1;

FIG. 3 is a partial frontal view, partially and cross-section, of the breathing tube of the snorkel depicted in FIG. 1;

DETAILED DESCRIPTION OF THE PREFERRED EMBODIMENT

Figure 4:
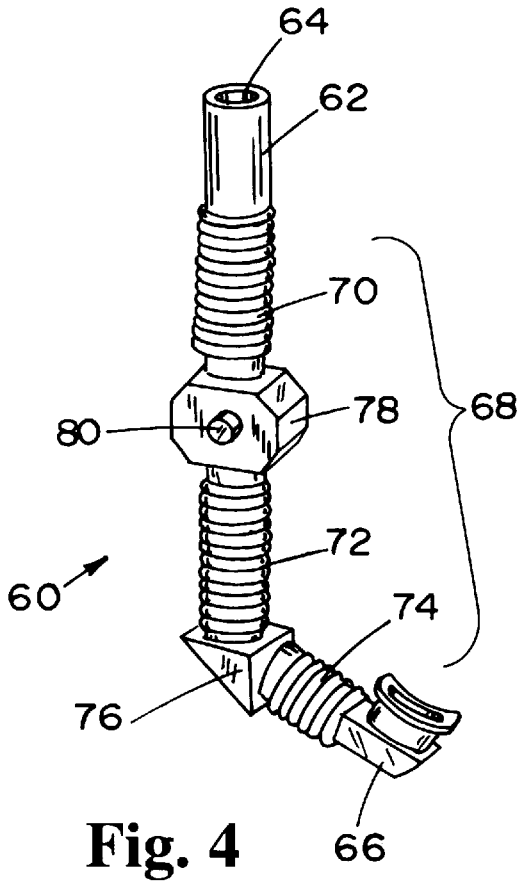
FIG. 4 is a perspective view of a snorkel constructed according to a second preferred embodiment of the present invention assuming a first operative configuration.

The detailed description set forth below in connection with the appended drawings is intended merely as a description of the presently preferred embodiments of the invention, and is not intended to represent the only forms in which the present invention may be constructed or utilized. The description sets forth the functions and sequence of steps for constructing and implementing of the invention in connection with the illustrated embodiments. It is to be understood, however, that the same or equivalent functions and sequences may be accomplished by different embodiments that are also intended to be encompassed within the spirit and scope of the invention.

Referring to the Figures, and initially to FIG. 1, there is shown a collapsible snorkel 10 constructed in accordance with a first preferred embodiment of the present invention. As illustrated, the snorkel 10 comprises an elongated breathing tube 12 having a distal portion 16, upon which is formed inlet valve 18 which defines an opening through which the diver 54 may breathe. The breathing tube further includes an angled proximal portion 14 upon which is formed a mouthpiece 20, the latter being designed and configured to engage with the diver's mouth. Formed between distal and proximal breathing tube sections 12, 14 is intermediate breathing tube section 24 which, as discussed more fully below, may be selectively lengthened or shortened to thus enable the snorkel 10 to assume a first fully-functional configuration, as per conventional snorkel devices, or alternatively, assume a second collapsed configuration such that when not in use, the snorkel 10 is maintained in a space-efficient, compact configuration so as to minimize interference with the diver.

Advantageously, while maintained in such space-efficient configuration, the snorkel 10 of the present invention substantially eliminates the problems of prior art snorkels to become entangled in conventional scuba diving equipment, such as the buoyancy compensator or regulator hoses, as well as the tendency of prior art snorkels to interfere with the diver's ability to dive in and around cramped spaces, such as caves and shipwrecks.

As illustrated, the intermediate breathing tube section 24 comprises an elongate portion of ribbed tubing 28. As more clearly seen in both FIGS. 1 and 2, the intermediate breathing tube section 24 and proximal breathing tube section 14 depending therefrom are rotatably connected to the distal breathing tube section 12 via annular collar 26, the latter being mounted upon the distal-most end of the ribbed tubing 28, such that the intermediate and proximal breathing tube sections 24, 14 may rotate in the direction indicated by the letter A.

The annular collar 26, which is preferably anchored to the distal breathing tube section 12 via its engagement with an annular lip 12*a* formed on the proximal end of the distal breathing tube 12, has formed thereon an annular base 26*a*. The annular base 26*a* includes an annular recess 46 for mating and engaging with a respective one of the plurality of ribs of the ribbed tubing 28. As will be appreciated, such engagement between the annular collar 26 and base 26*a* thereof with both the distal breathing tube section 12 and the ribbed tubing 28 of the intermediate breathing tube section 28 thus enables the intermediate breathing tube section 24 and proximal breathing tube section 14 to rotate in the manner described above.

In this regard, in the embodiment shown it will be recognized that the distal breathing tube section 12 will not be integrally formed with the ribbed tubing 28 of the intermediate breathing tube section 24. Rather, the respective sections will be joined via a cross-sectional cut 44 to thus accommodate and facilitate rotational movement.

With respect to the ability of the intermediate breathing tube section 24 to be selectively lengthened or shortened, there is shown in FIGS. 2 and 3 the mechanism which the intermediate breathing tube section 24 accompanies the same. As illustrated, depending from the annular collar 26, and more particularly the base 26*a* thereof, are first and second adjuster rails 30, 32. As more clearly shown in FIG. 3, the first and second adjuster rails 30, 32 are affixed to the base 26*a* of annular collar 26, via bolt fasteners 36*a*, 36*b* and extended downwardly therefrom in a generally parallel relationship to one another.

Each respective adjuster rail 30, 32 is provided with teeth 30*a*, 32*a* formed therein, respectively. The teeth of each of the adjuster rails 30*a*, 32*a* are designed and configured to mate and engage with first and second gear members 38, 40, respectively. Specifically, first gear member 38 is provided with teeth designed to engage with the teeth 30*a* formed within first rail member 30 and second gear member 40 is provided with teeth for mating and engaging with teeth 32*a* formed thereon the second adjuster rail 32. In this regard, the first and second gear members 38, 40 are mounted on opposed ends of axle 42, the latter extending transversely across the lumen of the breathing tube, which serves to align the gear members 38, 40 with the teeth 30*a* and 32*a* of the adjuster rails 30, 32.

Formed upon the end of axle 42, and just beyond second gear member 40, is a knob 34 which may be manually rotated by the diver in the directions indicated by B and C, as shown in FIG. 2. In this regard, by turning knob 34 in the direction indicated by the letter B, the length of intermediate breathing tube section 24 is caused to increase in length along axis D. Conversely, By rotating the knob in the direction indicated by the letter C, the ribbed tubing 28 will be caused to compress, thus shortening the length of the intermediate breathing tube section 24 along axis D.

Accordingly, when the diver desires to utilize the snorkel, as opposed to receiving air from the regulator, the diver need only rotate knob 34 in the direction indicated by the letter B to a point where the intermediate tube section has extended a length sufficient to enable the snorkel to assume its fully-functional configuration. However, during a dive, namely, where the snorkel cannot be used, the user need only rotate knob 34 in the direction indicated by the letter C such that the snorkel can assume a compact configuration. Additionally, as discussed above, the diver may rotate the intermediate and proximal breathing tube portions 14, 24 away from his/her mouth to enable a regulator to be utilized without obstruction from the snorkel.

Figure 5:
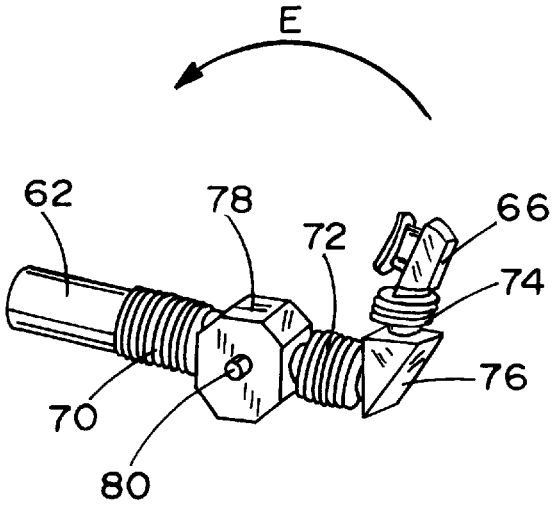
FIG. 5 is a perspective view of the snorkel depicted in FIG. 4 assuming a second collapsed configuration.

Referring now to FIGS. 4 and 5, and firstly to FIG. 4, there is illustrated a collapsible snorkel 60 constructed in accordance with a second preferred embodiment of the present invention. As illustrated, the snorkel 60 comprises an elongate breathing tube having a distal portion 62, with an opening 64 formed at the distal-most end thereof, and a mouthpiece 66 formed on the proximal-most end thereof. Disposed between the mouthpiece 66 and distal breathing tube portion 62 is an intermediate breathing tube portion 68, the latter being comprised of elastic tubing sections 70, 72, 74, elbow 76, and housing 78, the latter having a switch 80 formed thereon. Specifically, the housing 78 with switch 80 is formed intermediate elastic tubing sections 70, 72. Elbow 76, which is disposed between elastic tubing sections 72, 74, is necessary to properly angle the mouthpiece 66 toward the mouth of the diver.

As illustrated in FIG. 4, a snorkel 60 is capable of assuming a first fully-functional configuration such that the mouth piece 66 is oriented toward the mouth of the diver, while the distal portion 62, and more importantly air inlet 64 formed thereon, is angled upwardly to thus enable the diver to draw in air from the atmosphere through the mouthpiece 66 while the diver's head is downwardly oriented in the water. In this regard, distal breathing tube portion 62, along with elastic tubular segments 72, 74, cooperate to define a breathing tube lumen through which air may be inhaled and expired. As per convention snorkel devices, the snorkel 60, further preferably includes a strap connector device to enable the snorkel 60 to be fastened to the strap of the diver's mask (not shown). The snorkel 60 may thereafter be rotated about the diver's mask, indicated by the direction E, to thus further minimize interference.

The switch 80 formed on housing 78 enables the diver to selectively cause the snorkel 60 to transition between the fully-functional configuration depicted in FIG. 4, and the second compact configuration, depicted in FIG. 5. As will be recognized, elastic tubing sections 70, 72, 74 may be selectively lengthened or shortened by virtue of manipulation of the switch 80 formed upon the housing 78. According to one preferred embodiment, each of the respective elastic tubing sections 70, 72, 74 are comprised of spring-reinforced rubberized tubing. The switch 80 is coupled to either a mechanical or battery powered means for causing the respective elastic tubing sections 70, 72, 74 to transition between the configurations depicted in FIGS. 4 and 5. In this regard, the spring members disposed within the reinforced tubing may either be outwardly-biased, such that the snorkel 60 is biased to assume the fully-functional configuration depicted in FIG. 4 or, alternatively, are inwardly biased such that the snorkel 60 is caused to assume the compact configuration depicted in FIG. 5.

As will be recognized by those skilled in the art, the use of outwardly biased spring-reinforced tubing will thus require that the switching device housed within housing 78 impart a compressive force to the respective elastic tubing sections 70, 72, 74 to cause the same to transition to the compact configuration depicted in FIG. 5. Conversely, the use of tightly-coiled, inwardly-biased reinforced spring tubing will thus cause the snorkel 60 to be biased to assume the compact configuration, depicted in FIG. 5. In such cases, the switch 80 will necessarily be designed to apply an outwardly biasing force to thus cause the elastic tubing portions 70, 72, 74 to collectively expand in length to assume the operative configuration depicted in FIG. 4. As will be recognized by those skilled in the art, such switching apparatus housed within housing 78, and actuate via switching member 80, may take any of a variety of electrical or mechanical devices. For example, such a device may take the form of a manually operable or battery-powered crank, or other like device.

Additionally, while the aforementioned embodiments incorporate the use of elastic or stretchable tubing, it will be recognized by those skilled in the art that the tubing comprising the intermediate breathing tube section may take the form of sections of tubing that are telescoped within one another to thus enable such section of the breathing tube to assume elongate and shortened configurations. Accordingly, it is intended that all reasonably foreseeable additions, modifications, deletions and alterations be included within the scope of the invention as defined in the following claims.

What is claimed is:

1. A collapsible snorkel comprising an elongate breathing tube having proximal, intermediate and distal sections, said intermediate section comprising an elongate segment of extensible ribbed tubing being selectively transitionable between a first elongate configuration, and a second shortened configuration such that said snorkel is caused to substantially decrease in length and assume a compact configuration.

2. The collapsible snorkel of claim 1 wherein said collapsible snorkel further comprises a manually operable switching apparatus formed thereon for causing said intermediate section of said breathing tube to selectively transition between said first and second configurations.

3. The collapsible snorkel of claim 1 wherein said intermediate breathing tube section comprises a plurality of tubular segments telescoped within one another such that said tubular sections may be lengthened such that said intermediate section assumes said first configuration, and compressed to telescope axially within one another such that said intermediate section assumes said second configuration.

4. The collapsible snorkel of claim 1 wherein said intermediate breathing tube section comprises at least one segment of elastic, rubberized tubing having an elongate spring disposed within the lumen thereof.

5. The collapsible snorkel of the claim 4 wherein said spring member is integrally formed within said flexible tubing.

6. The collapsible snorkel of claim 1 further comprising:

a) an electrical apparatus for causing said intermediate breathing tube section to selectively transition between said first configuration and said second configurations;

b) a switch for causing said electrical apparatus to cause said intermediate breathing tube section to selectively transition between said first and second configuration;

c) a power source coupled to said electrical apparatus to provide power to said apparatus for causing said intermediate breathing tube section to assume said first and second configurations.

7. The collapsible snorkel of claim 1 wherein said intermediate and proximal breathing tube sections are rotatably mounted to said distal breathing tube sections.

8. The collapsible snorkel of claim 1 further comprising:

a) at least one elongate adjuster rail having proximal and distal ends and a plurality of teeth formed therein, said at least one adjuster rail being mounted to said breathing tube such that the length of said adjuster rail extends substantially along the length of said ribbed tubing; and b) at least one gear member mounted along the length of said breathing tube, said gear member having a plurality of teeth formed thereon designed to mate and engage with said teeth of said adjuster rail, said gear member having a knob formed thereon to enable the teeth of said gear to engage the teeth of said adjuster rail along the length thereof, said movement of said gear within said adjuster rail member causing said ribbed tubing to transition between said first and second configurations.

9. The collapsible snorkel of claim 8 wherein said snorkel further comprises:

e) a second elongate adjuster rail having a plurality of teeth formed therein, said adjuster rail being mounted to said breathing tube such that said second rail member extends in a generally parallel relation relative said first adjuster rail member;

f) a second gear member mounted to said breathing tube, said second gear member having a plurality of teeth formed thereon for engaging and mating with said plurality of teeth formed within said second adjuster having a plurality of teeth formed therewithin, said second gear member being mounted to said tubing and connected to said first gear member via an elongate axle transversely through the lumen of said breathing tube.

10. The collapsible snorkel of claim 4 wherein said intermediate breathing tube section comprises a first distal segment of elastic, rubberized tubing, an intermediate segment of elastic, rubberized tubing, and a proximal segment of elastic, rubberized tubing, each respective segment of tubing having a dedicated elongate spring disposed within the lumen thereof.

11. The collapsible snorkel of claim 10 further comprising;

a) a manually operable switching apparatus formed between said distal and intermediate tubing segments for selectively causing said distal, intermediate, and proximal tubing segments to collectively extend in length and collectively shorten in length such that said intermediate section assumes said first and second configurations.

12. The collapsible snorkel of claim 10 further comprising;

a) an elbow disposed intermediate said intermediate breathing tube segment and proximal breathing tube segment, said elbow being designed to configure to cause said breathing tube to assume a generally J-shape.

* * * * *